US009516431B2

(12) United States Patent
Kalluri et al.

(10) Patent No.: US 9,516,431 B2
(45) **Date of Patent: *Dec. 6, 2016**

(54) SPATIAL ENHANCEMENT MODE FOR HEARING AIDS

(71) Applicant: Starkey Laboratories, Inc., Eden Prairie, MN (US)

(72) Inventors: Sridhar Kalluri, El Cerrito, CA (US); Kelly Fitz, Eden Prairie, MN (US); John Ellison, St. Louis Park, MN (US); Donald James Reynolds, Pacifica, CA (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/939,245

(22) Filed: Nov. 12, 2015

(65) Prior Publication Data

US 2016/0142833 A1 May 19, 2016

Related U.S. Application Data

(63) Continuation of application No. 13/715,190, filed on Dec. 14, 2012, now Pat. No. 9,191,755.

(51) Int. Cl.
*H04R 25/00* (2006.01)
*H04S 1/00* (2006.01)

(52) U.S. Cl.
CPC ..... *H04R 25/552* (2013.01); *H04R 25/407* (2013.01); *H04R 25/505* (2013.01); *H04R 25/554* (2013.01); *H04R 25/558* (2013.01); *H04S 1/00* (2013.01); *H04R 2225/51* (2013.01); *H04S 1/002* (2013.01); *H04S 1/005* (2013.01);

(Continued)

(58) Field of Classification Search
None
See application file for complete search history.

(56) References Cited

U.S. PATENT DOCUMENTS 7,561,707 B2 7/2009 Kornagel
9,191,755 B2 * 11/2015 Kalluri ..... H04R 25/552
(Continued)

FOREIGN PATENT DOCUMENTS

EP 1194007 A2 4/2002
EP 1962556 A2 8/2008
(Continued)

OTHER PUBLICATIONS

"U.S. Appl. No. 13/715,190, Corrected Notice of Allowance mailed Jul. 22, 2015", 6 pgs.

(Continued)

*Primary Examiner* — Thang Tran
(74) *Attorney, Agent, or Firm* — Schwegman Lundberg & Woessner, P.A.

(57) ABSTRACT

Described herein are techniques for artificially enhancing spaciousness in a hearing aid to improve the music listening experience. Such spatial enhancement is produced by doing signal processing in the hearing aid that mimics the acoustic effects of well-designed concert halls. The same techniques can also be applied to improving the experience of listening to recorded music reproduced and amplified over a speaker system, or to music streamed to the direct-audio input of a hearing aid.

20 Claims, 4 Drawing Sheets

(52) U.S. Cl.
CPC ..... *H04S 2420/01* (2013.01); *H04S 2420/07* (2013.01)

(56) References Cited

U.S. PATENT DOCUMENTS

| | | | | |
|---|---|---|---|---|
| 2004/0052391 | A1* | 3/2004 | Bren | H04R 25/43 381/331 |
| 2006/0198529 | A1 | 9/2006 | Kjems et al. | |
| 2007/0230729 | A1 | 10/2007 | Naylor et al. | |
| 2007/0291969 | A1 | 12/2007 | Tateno et al. | |
| 2008/0008341 | A1 | 1/2008 | Edwards | |
| 2008/0013762 | A1 | 1/2008 | Roeck et al. | |
| 2009/0087005 | A1 | 4/2009 | Reithinger et al. | |
| 2009/0116657 | A1 | 5/2009 | Edwards et al. | |
| 2010/0172506 | A1 | 7/2010 | Iwano | |
| 2011/0188662 | A1 | 8/2011 | Jensen et al. | |
| 2011/0280424 | A1 | 11/2011 | Takagi et al. | |
| 2012/0128163 | A1* | 5/2012 | Moerkebjerg | H04R 25/407 381/23.1 |
| 2013/0010973 | A1* | 1/2013 | Ma | H04R 25/356 381/23.1 |
| 2013/0101128 | A1 | 4/2013 | Lunner et al. | |
| 2013/0195302 | A1 | 8/2013 | Meincke et al. | |
| 2013/0308782 | A1 | 11/2013 | Dittberner et al. | |
| 2013/0343584 | A1 | 12/2013 | Bennett | |
| 2014/0064496 | A1 | 3/2014 | Li | |
| 2014/0086417 | A1 | 3/2014 | Hansen et al. | |
| 2014/0169570 | A1 | 6/2014 | Kalluri et al. | |
| 2014/0321682 | A1 | 10/2014 | Kofod-Hansen et al. | |

FOREIGN PATENT DOCUMENTS

| | | | |
|---|---|---|---|
| EP | 1471770 | B1 | 7/2010 |
| WO | WO-2004049759 | A1 | 6/2004 |
| WO | WO-2009010116 | A1 | 1/2009 |
| WO | WO-2009102750 | A1 | 8/2009 |

OTHER PUBLICATIONS

"U.S. Appl. No. 13/715,190, Non Final Office Action mailed Mar. 2, 2015", 9 pgs.
"U.S. Appl. No. 13/715,190, Notice of Allowance mailed Jun. 22, 2015", 5 pgs.
"U.S. Appl. No. 13/715,190, Response filed Jun. 2, 2015 to Non Final Office Action mailed Mar. 2, 2015", 9 pgs.
"European Application Serial No. 13196768.9, Extended European Search Report mailed Jun. 6, 2014", 10 pgs.
"European Application Serial No. 13196768.9, Response filed Jan. 6, 2015 to Extended European Search Report mailed Jun. 6, 2014", 30 pgs.
"European Application Serial No. 13196768.9, Communication pursuant to Article 94(3) EPC mailed Sep. 30, 2015", 7 pgs.

* cited by examiner

SPATIAL ENHANCEMENT MODE FOR HEARING AIDS

CLAIM OF PRIORITY

This present application is a continuation of U.S. application Ser. No. 13/715,190, filed Dec. 14, 2012, which is incorporated herein by reference in its entirety.

FIELD OF THE INVENTION

This invention pertains to devices and methods for treating hearing disorders and, in particular, to electronic hearing aids.

BACKGROUND

Hearing aids are electronic instruments worn in or around the ear that compensate for hearing losses by amplifying and processing sound so as to help people with hearing loss hear better in both quiet and noisy situations. Hearing aid wearers often complain of a diminished ability to perceive and appreciate the richness of live music. Their diminished experience is due (at least in part) to the inability to perceive the binaural cues that convey the spatial aspects of the live music experience to listeners with normal hearing. It has also long been recognized that listeners prefer music that appears to emanate from a broad spatial extent over that emanating from a narrow point source. Stereo and surround sound consumer audio formats recognize this preference, and correspondingly generate spacious audio experiences for listeners. Concert hall architects also recognize this preference and design halls to enhance the spaciousness of a musical performance. Listeners with hearing loss, especially those whose impairment is moderate-severe to severe, have deficits in the perception of the binaural cues that convey spaciousness. Indeed, even listeners with milder hearing losses can have such deficits.

DETAILED DESCRIPTION

Designers of concert halls achieve a sense of spaciousness or envelopment by ensuring that there are significant reflections of the direct sound coming from the lateral walls. These lateral reflections cause a sense of spaciousness by de-correlating the signals at the two ears. Intuitively, the sense of spaciousness comes from the de-correlated signals giving an impression that the same sound is arriving simultaneously from multiple locations. Indeed, inter-aural decorrelation is manifested in the brain as random fluctuations of the binaural disparity cues that underlie the perceived lateral angle of a sound source. The perceptual effect is that of an auditory image that has a broad spatial extant.

Described herein are techniques for artificially enhancing spaciousness in a hearing aid to improve the music listening experience. Such spatial enhancement is produced by doing signal processing in the hearing aid that mimics the acoustic effects of well-designed concert halls. Although the primary objective is to improve the experience of a live music performance, the same techniques can also be applied to improving the experience of listening to recorded music reproduced and amplified over a speaker system, or to music streamed to the direct-audio input of a hearing aid. Spatial enhancement may also be applied to speech listening, wherein the spaciousness is enhanced subsequent to signal processing such as directional filtering that degrades binaural cues for spaciousness. For such speech listening applications, it may be desirable to restrict it to situations in which speech reception is good so that the spatial enhancement processing, which has the potential to degrade speech reception, has minimal impact on intelligibility.

It may be desirable to apply the spatial enhancement processing only in some environments, specifically those in which natural cues for spaciousness are absent. Examples of such environments are music listening outdoors or in very large indoor venues, music listening when directional processing is activated in the hearing aids (e.g., in a noisy nightclub where it might be desirable to activate directionality in order to suppress background noise), listening to music streamed directly to the hearing aid, and speech listening with directional processing. In each of these examples, spaciousness processing should enhance sound quality.

Figure 1:
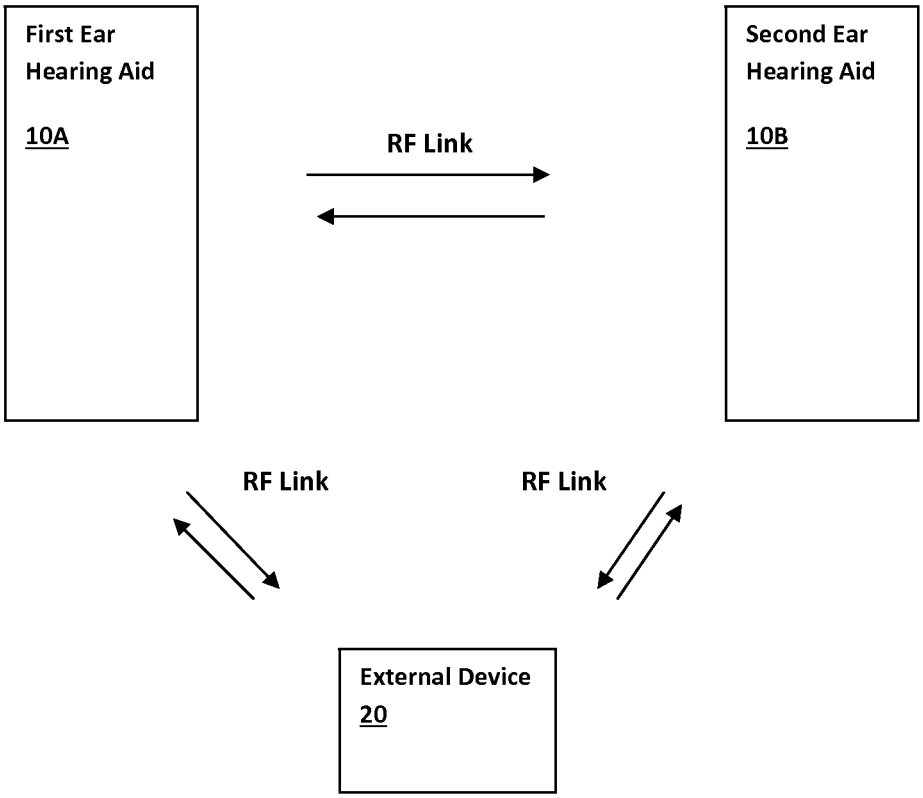
FIG. 1 illustrates an example hearing assistance system.

The electronic circuitry of a hearing aid is contained within a housing that is commonly either placed in the external ear canal or behind the ear. In an example embodiment, a hearing assistance system comprises first and second hearing aids for providing audio outputs to both ears such as shown in FIG. 1 as hearing aids 10A and 10B. Each of the first and second hearing aids comprises an input transducer for converting sound into a first or second input signal, respectively, and processing circuitry for filtering and amplifying the input signal in accordance with specified signal processing parameters to produce a first or second output signal, respectively. The hearing aids are further equipped with circuitry for converting the output signals into sound. Each of the first and second hearing aids may each further comprise a user interface connected to their processing circuitries. The user interface may be implemented with an RF (radio frequency) transceiver that provides an RF link to an external device 20 such as a dedicated external programmer or any type of computing device such as a personal computer or smart phone. As described herein, the processing circuitries of the first and second hearing aids are further configured to operate in a spatial enhancement mode that de-correlates the first and second output signals. The processing circuitries may be configured to enter the spatial enhancement mode upon a command from the user interface. In certain embodiments, an RF link between the two hearing aids is used in the spatial enhancement mode.

Figure 2:
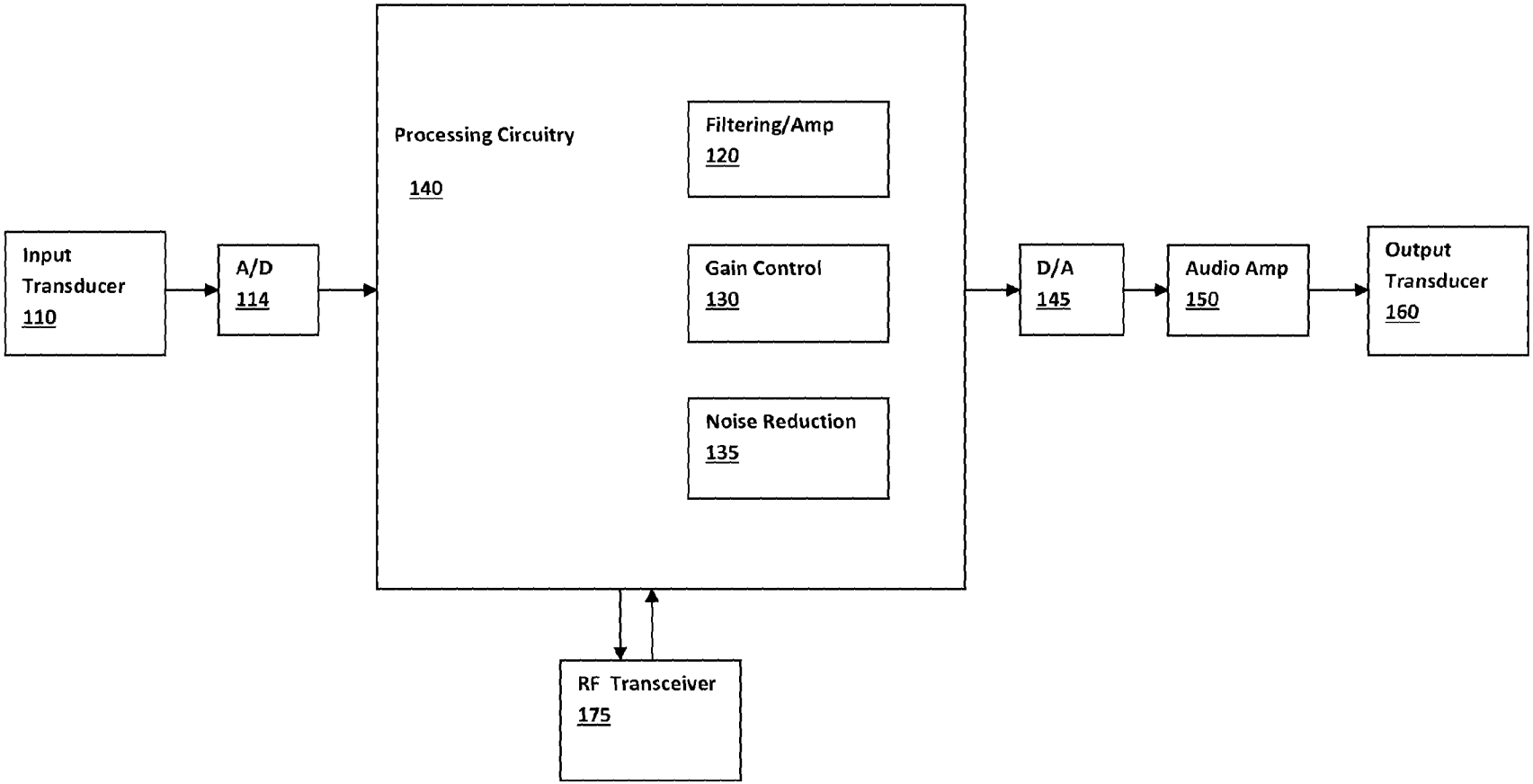
FIG. 2 illustrates the basic components of a hearing aid.

An example of the basic components of either hearing aid 10A or 10B are as shown in FIG. 2. A microphone or other input transducer 110 receives sound waves from the environment and converts the sound into an input signal that is sampled and digitized by A/D converter 114. Other embodiments may incorporate an input transducer that produces a digital output directly. The device's processing circuitry 140 processes the digitized input signal into an output signal in a manner that compensates for the patient's hearing deficit. The output signal is then converted to analog form by D/A converter 145 and passed to an audio amplifier 150 that drives an output transducer 160 for converting the output signal into an audio output, such as a speaker within an earphone.

In the embodiment illustrated in FIG. 2, the processing circuitry 140 may comprise a programmable processor and associated memory for storing executable code and data. The overall operation of the device is then determined by the programming of the processor, which programming may be modified via a user interface, shown in FIG. 2 as being implemented with RF (radio frequency) transceiver 175. The programming interface allows user input of data to a parameter modifying area of the processing circuitry's memory so that parameters affecting device operation may be changed. The programming interface may allow communication with a variety of external devices for configuring the hearing aid such as industry standard programmers, wireless devices, or belt-worn appliances.

The signal processing modules 120, 130, and 135 may represent specific code executed by the processor or may represent additional hardware components. The processing done by these modules may be performed in the time-domain or the frequency domain. In the latter case, the input signal is discrete Fourier transformed (DFT) prior to processing and then inverse Fourier transformed afterwards to produce the output signal for converting into sound. Any or all of the processing functions may also be performed for a plurality of frequency-specific channels, each of which corresponds to a frequency component or band of the audio input signal. Because hearing loss in most patients occurs non-uniformly over the audio frequency range, most commonly in the high frequency range, the patient's hearing deficit is compensated by selectively amplifying those frequencies at which the patient has a below-normal hearing threshold. The filtering and amplifying module 120 may therefore amplify the input signal in a frequency specific manner. The gain control module 130 dynamically adjusts the amplification in accordance with the amplitude of the input signal to either expand or compress the dynamic range and is sometimes referred to as a compressor. Compression decreases the gain of the filtering and amplifying circuit at high input signal levels so as to avoid amplifying louder sounds to uncomfortable levels. The gain control module may also apply such compression in a frequency-specific manner. The noise reduction module 135 performs functions such as suppression of ambient background noise and feedback cancellation.

As noted above, hearing aids typically perform signal processing in a frequency-specific manner, usually referred to as multichannel or multiband processing. In the time domain technique, a filter bank is used to separate the input signal into a multiplicity of frequency bands. The lowest frequencies are output by a low-pass filter, the highest frequencies by a highpass filter, and the remaining intermediate frequencies by band-pass filters. The input signal is convolved with the filters one sample at a time, and the output signal is formed by summing the filter outputs. The alternative frequency domain technique divides the input signal into short segments, transforms each segment into the frequency domain, processes the computed input spectrum, and then inverse transforms the segments to return to the time domain. Hearing aids may perform some functions in the time domain and others in the frequency domain. The spatial enhancement techniques described below may be performed in either the time domain or frequency domain upon discrete segments of the input signal that are then joined together to form the final output signal.

Phase Jittering

In one embodiment spaciousness is enhanced by randomly modifying phase in each channel of multiband signal processing in the hearing aids independently at the left and right ear. Such jittering is easily done, and requires little computational overhead, in hearing aids that already do multiband frequency domain signal processing for other purposes. Computational savings can be gained by doing the processing in a band-limited manner, for instance below 1500 Hz which is the frequency range in which humans are particularly sensitive to inter-aural de-correlation.

In a particular embodiment, the processing circuitries of the first and second hearing aids are configured to pseudo-randomly jitter the phases of their respective output signals in the spatial enhancement mode. The jittering may be performed as the input signal is processed in the frequency domain or the time domain, the latter being equivalent to time delay jittering, and may be applied in a frequency-specific manner. For example, the jittering may be applied with different parameters to different frequency bands of the input signal and/or the pseudo-random jittering may be performed only for frequency components of the input signal below a specified frequency (e.g., 1500 Hz).

The processing for doing the jittering may also be divided between the two hearing aids for computational efficiency. For example, one hearing aid may perform the jittering for one half of the frequency bands of the input signal, while the other hearing aid jitters the second half. In one embodiment, the processing circuitry of the first hearing aid is configured to perform pseudo-random jittering for at least one frequency component of the first input signal for which the corresponding frequency component of the second input signal is not pseudo-randomly jittered by the processing circuitry of the second hearing aid. In another embodiment, the processing circuitries of the first and second hearing aids are configured to perform pseudo-random jittering for different frequency components of their respective first and second input signals. The different frequency components jittered by each hearing aid may be in contiguous or non-contiguous frequency bands.

Figure 3:
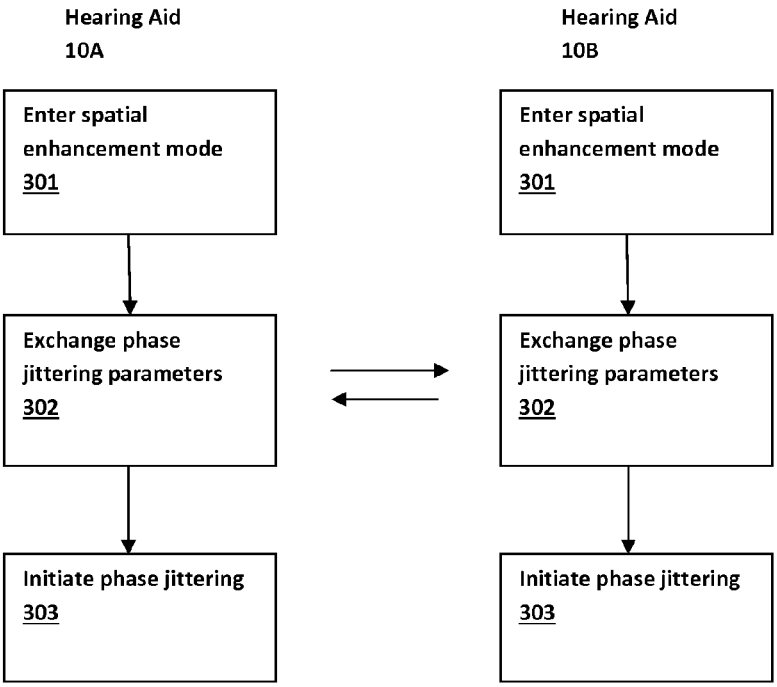
FIGS. 3 and 4 illustrate steps performed in enhancing spaciousness by phase jittering.
Figure 4:
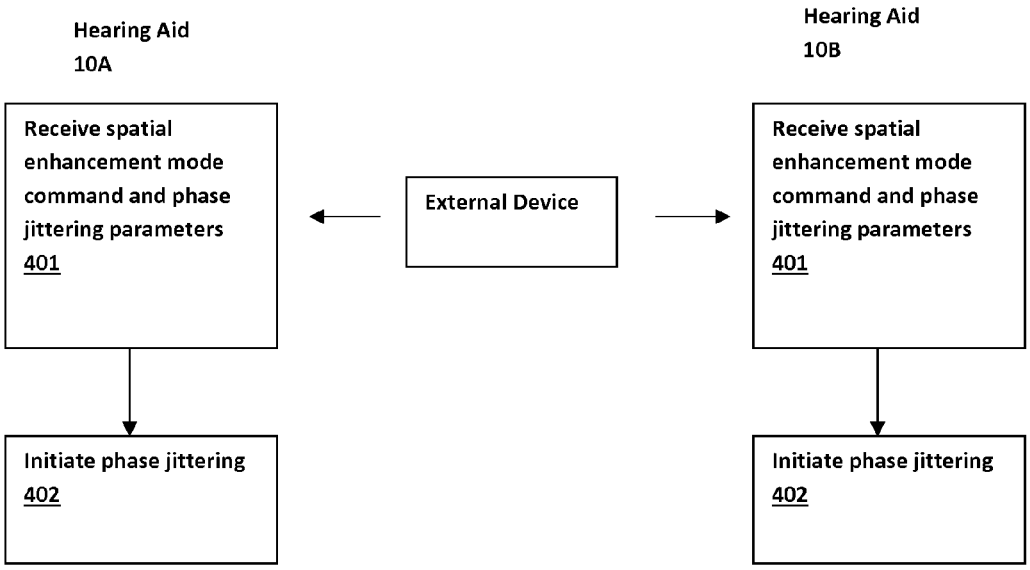

In an embodiment in which the first and second hearing aids each further comprise a radio-frequency (RF) transceiver connected to their processing circuitries, the processing circuitries may be configured to exchange parameters for pseudo-random jittering via an RF link between the two hearing aids upon initiation of the spatial enhancement mode. FIG. 3 shows the steps performed by each of the hearing aids 10A and 10B: the hearing aids receive a command to enter the spatial enhancement mode at step 301 (e.g., via the user interface), jittering parameters are exchanged or agreed upon via the RF link at step 302, and phase jittering is initiated at step 303. Alternatively, as shown in FIG. 4, the two hearing aids may receive parameters for the jittering from an external device via an RF link together with a command to enter the spatial enhancement mode at step 401 and then initiate phase jittering at step 402.

Head-Related Room Impulse Response

In another embodiment, the hearing aids enhance spaciousness by applying generic head-related room impulse responses to the hearing aids at the left and right ears. The impulse responses used can be measured at the left and right ears of a dummy head in rooms and source locations that give good auditory spaciousness. One might even allow a patient to select from a library of rooms that are stored on the hearing aid, or selected and load from an external device such as a smart phone. The impulse responses at the two ears will differ from each other, particularly the parts due to early lateral reflections from the side walls of the room; it is these differences that give rise to the sense of spaciousness. Because it is the early reflections that contribute most to the sense of spaciousness, computational savings can be gained by truncating the impulse responses such that only early reflections are preserved and late reflections are eliminated.

Figure 5:
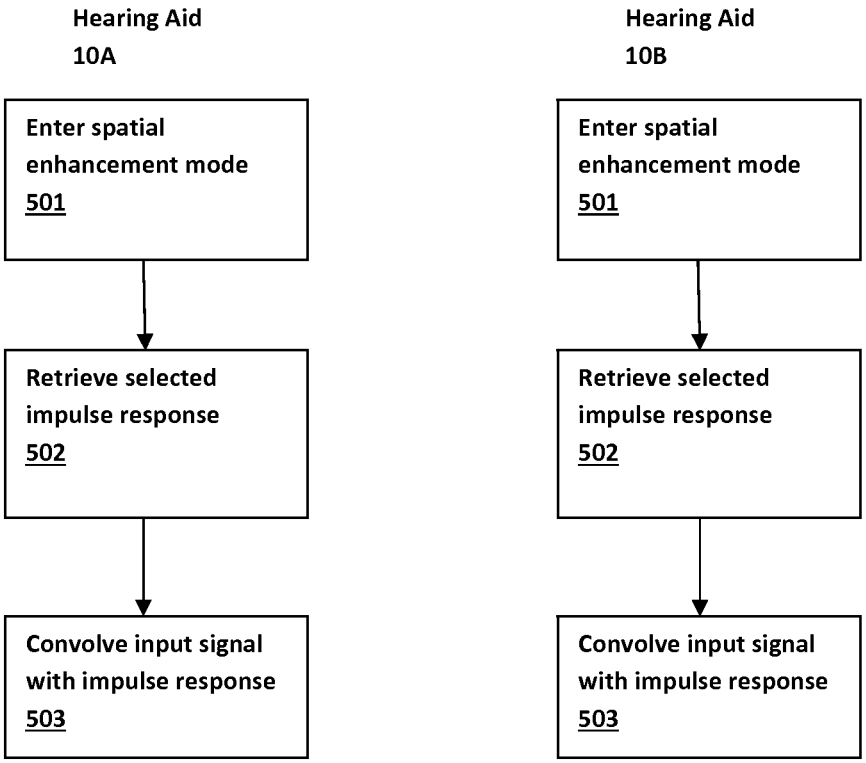
FIG. 5 illustrates steps performed in enhancing spaciousness by convolving with a head-related impulse response.

In a particular embodiment, the processing circuitries of the first and second hearing aids are configured to employ a stored head-related room impulse response for each ear to produce an output signal in the spatial enhancement mode. In this embodiment, the processing circuitry of each hearing aid convolves its input signal with the stored impulse response in the time domain or performs an equivalent operation in the frequency domain. The stored head-related room impulse response may be produced from measurements of impulse responses recorded at the left and right ears of a dummy head in a selected environment. The measurements of the impulse responses at the left and right ears of the dummy head may be truncated to preserve early reflections and eliminate late reflections. A plurality of such head-related impulse responses may be stored, where the processing circuitries of the first and second hearing aids are then configured to select from the plurality of stored head-related room impulse responses to produce their output signals in the spatial enhancement mode. FIG. 5 shows the example steps performed in this embodiment. At step 501, each of the hearing aids receives a command to enter the spatial enhancement mode from an external device. The processing circuitries of each hearing aid then retrieve a selected head-related room impulse response from memory at step 502. In the case where multiple impulse responses are stored, the command to enter the spatial enhancement mode may include a selection parameter that indicates which impulse response should be used. At step 503, the input signal is convolved with the retrieved impulse response to produce the output signal for converting into sound (or multiplied by an equivalent transfer function in the frequency domain).

Mid-Side Processing

In addition to the techniques for de-correlating left and right output signals by the techniques described above, mid/side processing is another way to improve spaciousness. Mid/side processing refers to segregating the ambient (side) part of the sound from the nearfield (mid) part. In this segregated domain, one may perform processing separately and differently on the ambient and nearfield parts of the signal before recombining them into a binaural signal presented by the two hearing aids. Mid/side processing could be combined with those de-correlation techniques or used alone.

In the mid/side processing technique, the ambient and nearfield parts of the signal are formed from a sum of the first and second input signals and a difference between the two signals. This operation may be performed by both of the first and second hearing aids, where the input signal from one hearing aid is transmitted to the other via the RF link using RF transceivers incorporated into each hearing aid. The resulting ambient and nearfield signals may then be processed non-linearly and recombined, possibly multiple times. An example sequence of operations is as follows: 1) separating each of the first and second input signals into ambient and nearfield signals by summing and subtracting the first and second input signals, 2) performing separate compressive amplification of the ambient and nearfield signals by each hearing aid, 3) generating first and second output signals by recombining the signals with a weighted combination, 4) repeating steps 1-3 a specified number of times.

In another embodiment, the spatial enhancement mode employing any of the de-correlation techniques described above may include further processing of the output signals that involves computing sums and differences between the output signals computed by each of the first and second hearing aids. In this embodiment, the first and second hearing aids each further comprise a radio-frequency (RF) transceiver connected to their processing circuitries for providing an RF link between the two hearing aids in order to communicate their respective output signals to the other hearing aid. The processing circuitry of each hearing aid is configured to produce a final output signal as a weighted sum of the de-correlated output signals produced by the processing circuitries of both of the first and second hearing aids. The processing can be inexpensively done in the time domain, but it could be done in the frequency domain as well.

Direct Transmission of Input Signal

The above-described embodiments have applied spatial enhancement processing to input signals produced by the hearing aids from actual sounds. Such spatial enhancement processing may also be applied to input signals transmitted directly to the hearing aids from an external device. For example, a music player (e.g., a smart phone) may wireless transmit one channel of a stereo signal to each hearing aid via the RF link or a wired connection. The received input signals are processed in the spatial enhancement mode in same manner as described above with respect to input signals derived from actual sounds.

User Adjustment of De-Correlation Parameters

In another embodiment, the user interface as described above may be configured to allow users to adjust the de-correlation parameters used in the above-described embodiments to suit their personal preferences for particular listening situations. For example, in the case of phase jittering, a user may adjust the amount of jittering and/or the frequency bands to which the jittering is applied. In the case of mid-side processing, the user may adjust the weightings used to combine the ambient and nearfield signals.

The subject matter has been described in conjunction with the foregoing specific embodiments. It should be appreciated that those embodiments and specific features of those embodiments may be combined in any manner considered to be advantageous. Also, many alternatives, variations, and modifications will be apparent to those of ordinary skill in the art. Other such alternatives, variations, and modifications are intended to fall within the scope of the following appended claims.

What is claimed is:

1. A hearing assistance system, comprising:

a first hearing aid comprising an input transducer for converting sound into a first input signal, processing circuitry for filtering and amplifying the first input signal in accordance with specified signal processing parameters to produce a first output signal, and an output transducer for converting the first output signal into sound for a first ear;

a second hearing aid comprising an input transducer for converting sound into a second input signal, processing circuitry for filtering and amplifying the second input signal in accordance with specified signal processing parameters to produce a second output signal, and an output transducer for converting the second output signal into sound for a second ear;

wherein the first and second hearing aids each further comprise a radio-frequency (RF) transceiver connected to their processing circuitries for providing an RF link, wherein the RF transceivers are configured to communicate the first input signal to the second hearing aid and communicate the second input signal to the first hearing aid;

wherein the processing circuitries of the first and second hearing aids, in a spatial enhancement mode, are configured to: sum and subtract the first and second input signals to separate each of the first and second input signals into ambient and nearfield signals, compress and amplify the ambient and nearfield signals, and recombine the compressed and amplified ambient and nearfield signals with a weighted combination to produce the first and second output signals.

2. The system of claim 1 wherein the processing circuitries of the first and second hearing aids are configured to sum and subtract the first and second input signals and recombine the compressed and amplified ambient and nearfield signals with a weighted combination a specified number of times.

3. The system of claim 1 wherein the first and second hearing aids each further comprise a user interface connected to their processing circuitries configured to allow a user to adjust the weightings used to combine the ambient and nearfield signals.

4. The system of claim 1 wherein the processing circuitries of the first and second hearing aids are configured to de-correlate the first and second output signals.

5. The system of claim 4 wherein the processing circuitries of the first and second hearing aids are configured to pseudo-randomly jitter the phases of the first and second output signals in order to de-correlate the first and second output signals.

6. The system of claim 1 wherein the first and second hearing aids each further comprise a user interface connected to their processing circuitries and further wherein the processing circuitries are configured to enter the spatial enhancement mode upon a command from the user interface.

7. The system of claim 5 wherein the first and second hearing aids each further comprise a radio-frequency (RF) transceiver connected to their processing circuitries for providing an RF link and further wherein the processing circuitries are configured to exchange parameters for pseudo-random jittering via the RF link upon initiation of the spatial enhancement mode.

8. The system of claim 5 wherein the pseudo-random jittering is performed only for frequency components of the first and second input signals below a specified frequency.

9. The system of claim 5 wherein the specified frequency is 1500 Hz.

10. The system of claim 5 wherein the processing circuitry of the first hearing aid is configured to perform pseudo-random jittering for at least one frequency component of the first input signal for which the corresponding frequency component of the second input signal is not pseudo-randomly jittered by the processing circuitry of the second hearing aid.

11. The system of claim 5 wherein the processing circuitries of the first and second hearing aids are configured to perform pseudo-random jittering for different frequency components of their respective first and second input signals.

12. The system of claim 5 wherein the first and second hearing aids each further comprise a user interface connected to their processing circuitries configured to allow a user to adjust the amount of jittering.

13. The system of claim 5 wherein the first and second hearing aids each further comprise a user interface connected to their processing circuitries configured to allow a user to adjust the frequency bands to which the jittering is applied.

14. The system of claim 5 wherein the processing circuitries of the first and second hearing aids are configured to, in the spatial enhancement mode, perform a time domain or frequency domain convolution that convolves the first input signal with a stored head-related room impulse response for the first ear to produce the first output signal and to perform a time domain or frequency domain convolution that convolves the second input signal with a stored head-related room impulse response for the second ear to produce the second output signal.

15. The system of claim 14 wherein the stored head-related room impulse response is produced from measurements of impulse responses recorded at the left and right ears of a dummy head in a room and with source locations that result in an enhanced perception of auditory spaciousness.

16. The system of claim 15 wherein the measurements of the impulse responses at the left and right ears of the dummy head are truncated to preserve early reflections and eliminate late reflections.

17. A method, comprising:

converting sound into a first input signal, filtering and amplifying the first input signal in accordance with specified signal processing parameters to produce a first output signal, and converting the first output signal into sound for a first ear;

converting sound into a second input signal, filtering and amplifying the second input signal in accordance with specified signal processing parameters to produce a second output signal, and converting the second output signal into sound for a second ear;

communicating the first input signal to the second hearing aid and the second input signal to the first hearing aid via an RF link and, operating in a spatial enhancement mode by: separating each of the first and second input signals into ambient and nearfield signals by summing and subtracting the first and second input signals, compressing and amplifying the ambient and nearfield signals, and generating first and second output signals by recombining the compressed and amplified ambient and nearfield signals with a weighted combination.

18. The method of claim 17 further comprising repeating separating each of the first and second input signals into ambient and nearfield signals by summing and subtracting the first and second input signals and generating first and second output signals by recombining the compressed and amplified ambient and nearfield signals with a weighted combination a specified number of times.

19. The method of claim 17 further comprising allowing a user to adjust the weightings used to combine the ambient and nearfield signals.

20. The method of claim 17 further comprising de-correlating the first and second output signals.

* * * * *